US006242860B1

(12) United States Patent
Sasao et al.

(10) Patent No.: US 6,242,860 B1
(45) **Date of Patent: *Jun. 5, 2001**

(54) PLASMA DISPLAY PANEL AND METHOD OF MANUFACTURING SAME

(75) Inventors: Hiromichi Sasao, Kagosima; Hiroyuki Nakahara, Kawasaki; Toshiyuki Nanto, Kawasaki; Akira Otsuka, Kawasaki; Noriyuki Awaji, Kawasaki; Keiichi Betsui, Kawasaki; Shinji Tadaki, Kawasaki, all of (JP)

(73) Assignee: Fujitsu Limited, Kawasaki (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/812,044

(22) Filed: Mar. 6, 1997

(30) Foreign Application Priority Data

Jun. 11, 1996 (JP) ..... 8-148767
Feb. 12, 1997 (JP) ..... 9-027996

(51) Int. Cl.[7] ..... H01J 17/49

(52) U.S. Cl. ..... 313/586; 313/586; 313/584; 313/585; 313/587

(58) Field of Search ..... 313/584, 585, 313/586, 587

(56) References Cited

U.S. PATENT DOCUMENTS 3,984,718 * 10/1976 Fein et al. ..... 313/587
3,996,489 * 12/1976 Bryum, Jr. et al. ..... 313/587
4,028,578 * 6/1977 Bryum, Jr. et al. ..... 313/587
4,109,176 * 8/1978 Ernsthausen et al. ..... 313/587
4,120,808 * 10/1978 Bryum, Jr. et al. ..... 313/587
4,133,934 * 1/1979 Fein et al. ..... 313/587
4,340,840 7/1982 Aboelfotoh et al. .
4,843,281 6/1989 Mendelsohn ..... 313/587

FOREIGN PATENT DOCUMENTS 56-152137 11/1981 (JP) .
57-107536 7/1982 (JP) .
01-124938 5/1989 (JP) .
4-95332 3/1992 (JP) .
04-132142 5/1992 (JP) .
07-199826 8/1995 (JP) .

* cited by examiner

*Primary Examiner*—Ashok Patel
(74) *Attorney, Agent, or Firm*—Staas & Halsey LLP

(57) ABSTRACT

A plasma display panel has a first substrate, a plurality of address electrodes disposed on the first substrate, a first dielectric layer disposed on the first substrate in covering relation to the address electrodes, a second substrate, a plurality of scan electrodes disposed on the second substrate in a direction transverse to the address electrodes, a second dielectric layer disposed on the second substrate in covering relation to the scan electrodes. The first substrate and the second substrate are disposed in confronting relation to each other with discharge spaces defined therebetween. The first dielectric layer contains electrically conductive particles mixed therewith. The electrically conductive particles make the first dielectric layer electrically conductive in its transverse direction to allow charges stored on the first dielectric layer to leak to the address electrodes for thereby reducing the frequency of random discharges.

26 Claims, 12 Drawing Sheets

EVALUATION RESULT OF PDP

*EVALUATION RESULT OF PDP*

PLASMA DISPLAY PANEL AND METHOD OF MANUFACTURING SAME

BACKGROUND OF THE INVENTION

1. Field of the Invention

The present invention relates to a plasma display panel (PDP) and a method of manufacturing such a plasma display panel, and more particularly to a plasma display panel structure for preventing random discharges of a three-electrode-surface-discharge AC plasma display panel and a method of manufacturing such a plasma display panel structure.

2. Description of the Prior Art

Surface-discharge AC plasma display panels have been drawing attention in the art for use as large-screen full-color display devices. A three-electrode-surface-discharge AC plasma display panel has a plurality of parallel display electrodes (hereinafter referred to as X and Y electrodes) disposed on a glass substrate, for generating surface discharges, and address electrodes and phosphor layers which are disposed on an opposite glass substrate, the address electrodes extending perpendicularly to the X and Y electrodes. The three-electrode-surface-discharge AC plasma display panel is basically operated by resetting itself with a large voltage applied between the X and Y electrodes, causing a discharge between the Y electrodes, which serve as scan electrodes, and the address electrodes, and applying a sustain voltage between the X and Y electrodes, producing a sustain discharge depending on the luminance of an image to be displayed based on stored wall charges.

As described later on, space charges are produced as a result of a plasma discharge that occurs between the Y electrodes and the address electrodes, and mostly stored on a dielectric layer disposed on the X and Y electrodes. Part of the generated space charges is used as an ignition voltage for a writing discharge to occur between a next scan electrode and a Y electrode.

Part of the generated space charges moves with the scanning process until it is stored in the vicinity of first and last scan electrodes. As a result, a random discharge is produced under a large voltage due to the stored charges, degrading the quality of an image displayed on the plasma display panel. Though this phenomenon has not clearly been analyzed and understood in the art, it has been confirmed, at least, that it is caused by charges which are not utilized for a sustain discharge and are stored over the address electrodes.

SUMMARY OF THE INVENTION

It is therefore an object of the present invention to provide a plasma display panel structure preventing random discharges from occurring and a method of manufacturing such a plasma display panel structure.

Another object of the present invention is to provide a plasma display panel structure eliminating a stored charge which would otherwise be responsible for random discharges on a dielectric layer on address electrodes and a method of manufacturing such a plasma display panel structure.

Still another object of the present invention is to provide a plasma display panel structure leaking a stored charge which would otherwise be responsible for random discharges on a dielectric layer on address electrodes and a method of manufacturing such a plasma display panel structure.

Further, another object of the present invention is to provide a plasma display panel preventing a latch-up phenomenon causing address electrodes malfunction according to a discharge of the accumulated charge and a method of manufacturing such a plasma display panel.

To achieve the above objects, there is provided in accordance with the present invention a plasma display panel comprising a first substrate having a plurality of address electrodes disposed thereon and a first dielectric layer disposed thereon and covering the address electrodes; and a second substrate having a plurality of scan electrodes disposed thereon in a direction transverse to the address electrodes and a second dielectric layer disposed thereon and covering the scan electrodes. The first substrate and the second substrate are disposed in confronting relation to each other with discharge spaces defined therebetween, the first dielectric layer containing electrically conductive particles mixed therewith.

The electrically conductive particles make the first dielectric layer electrically conductive to allow charges generated by a plasma discharge and stored on the first dielectric layer to leak to the address electrodes for thereby preventing a storage of excessive charges which would otherwise lead to random discharges.

The electrically conductive particles are preferably made of either chromium or nickel, as metal particles, which are difficult to be oxidized. Further, the conductive particles may be a conductive oxide material. In such material, it is preferable to be a semiconductor material which is a metal oxide, like indium oxide, tin oxide, titanium oxide and etc., which is doped with impurities.

According to the present invention, the above objects can also be accomplished by a method of manufacturing a plasma display panel, comprising the steps of mixing electrically conductive particles having a predetermined diameter with glass of low melting point, coating and baking a layer of the glass of low melting point mixed with the electrically conductive particles on a first substrate which has a plurality of address electrodes disposed thereon, thereby to form a first dielectric layer on the first substrate, combining the first substrate in confronting relation with a second substrate which has a plurality of scan electrodes disposed thereon in a direction transverse to the address electrodes and a second dielectric layer covering the scan electrodes, filling a discharge gas between the first substrate and the second substrate, and sealing the first substrate and the second substrate with respect to each other.

The above and other objects, features, and advantages of the present invention will become apparent from the following description when taken in conjunction with the accompanying drawings which illustrate a preferred embodiment of the present invention by way of example.

DETAILED DESCRIPTION OF THE PREFERRED EMBODIMENT

Figure 1:
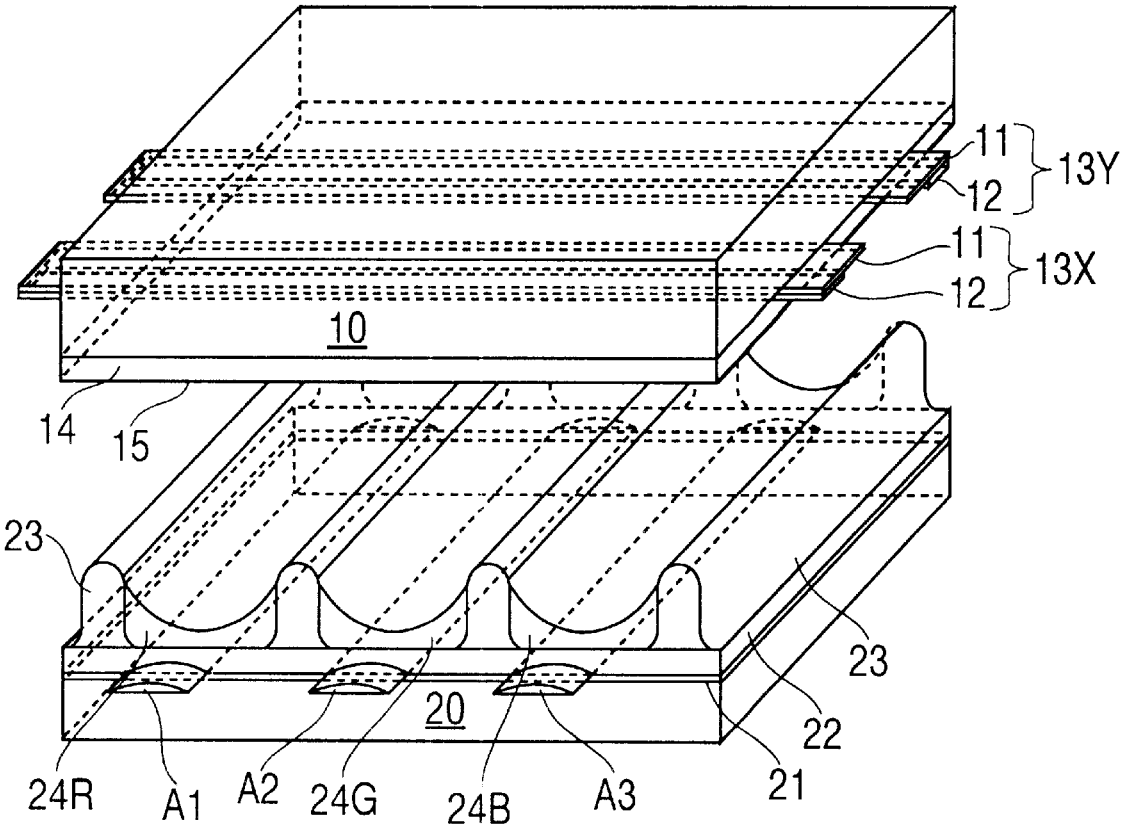
FIG. 1 is a fragmentary exploded perspective view of a three-electrode-surface-discharge AC plasma display panel according to the embodiment of the present invention.
Figure 2:
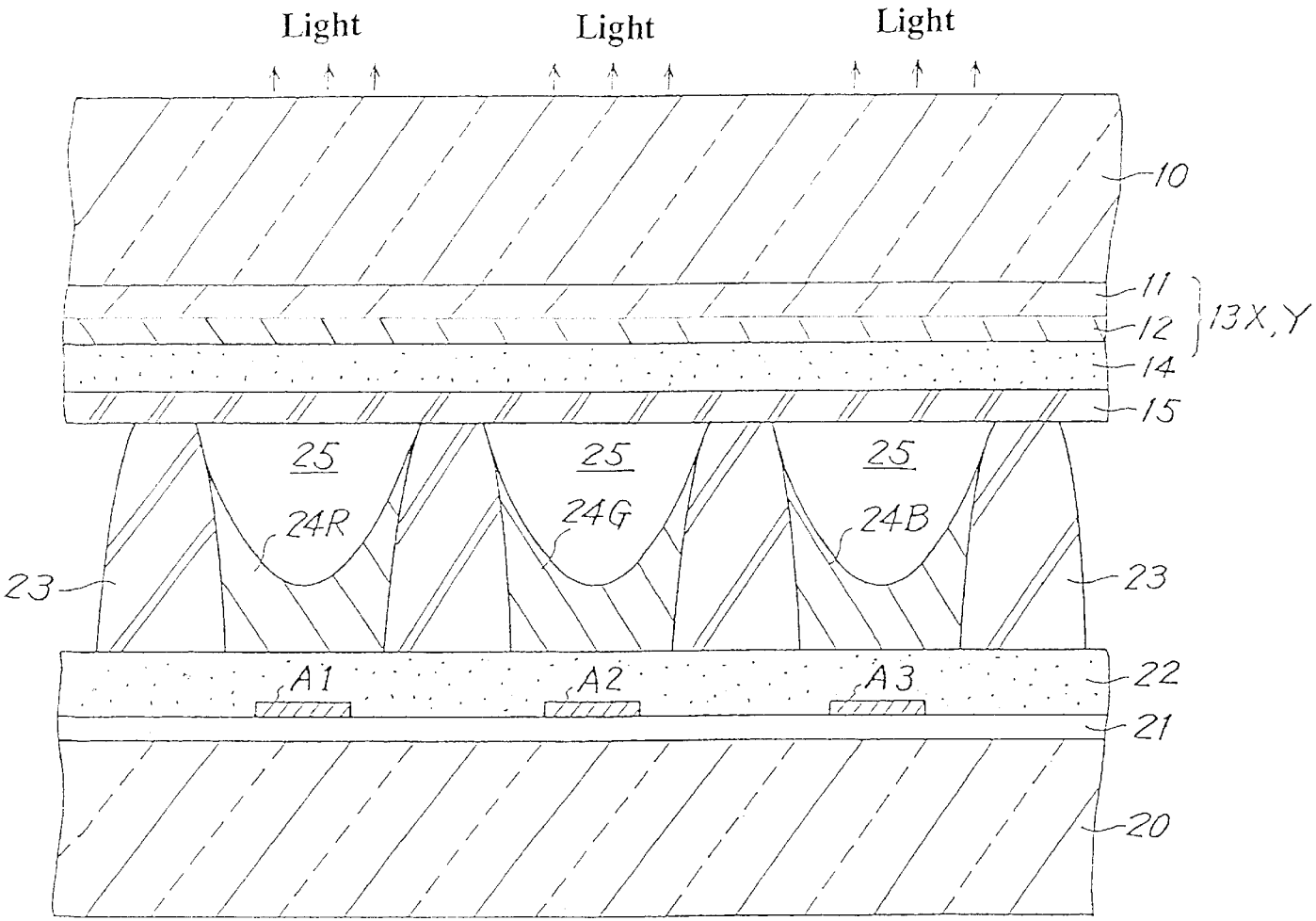
FIG. 2 is an enlarged fragmentary cross-sectional view of the three-electrode-surface-discharge AC plasma display panel shown in FIG. 1.

FIGS. 1 and 2 show a plasma display panel (PDP) according to the embodiment of the present invention.

As shown in FIGS. 1 and 2, the plasma display panel has a glass substrate 10 on a face side from which light is emitted in the direction indicated by the arrows in FIG. 2 and another glass substrate 20 on a back side. The glass substrate 10 supports thereon X electrodes 13X and Y electrodes 13Y, each comprising a transparent electrode 11 and a highly electrically conductive bus electrode 12 disposed on the transparent electrode 11. The bus electrode 12 is shown as being positioned underneath the transparent electrode 11 in FIGS. 1 and 2. The X electrodes 13X and Y electrodes 13Y are covered with a dielectric layer 14 and a protective layer 15 of MgO. The bus electrodes 12 are disposed on and along opposite edges of the X and Y electrodes in order to supplement the electric conductivity of the transparent electrodes 11.

The glass substrate 20 supports thereon a passivation base film 21 of silicon oxide, for example, address electrodes A1, A2, A3 disposed in a striped pattern on the passivation film 21, and a dielectric layer 22 covering the address electrodes A1, A2, A3. A striped pattern of partitions or ribs 23 is disposed on the dielectric layer 22 adjacent to the address electrodes A1, A2, A3, respectively. The ribs 23 serve to prevent an address electrode discharge from affecting adjacent cells and also to prevent light crosstalk. The upper surfaces of the dielectric layer 22 above the respective address electrodes A1, A2, A3 and adjoining wall surfaces of the ribs 23 are coated with red, blue, and green phosphor layers 24R, 24G, 24B between adjacent ones of the ribs 23.

As shown in FIG. 2, the glass substrates 10, 20 are combined with each other in confronting relation to each other with a gap of about 100 μm defined therebetween which provides discharge spaces 25 that are filled with a mixed discharge gas of Ne and Xe.

Figure 3:
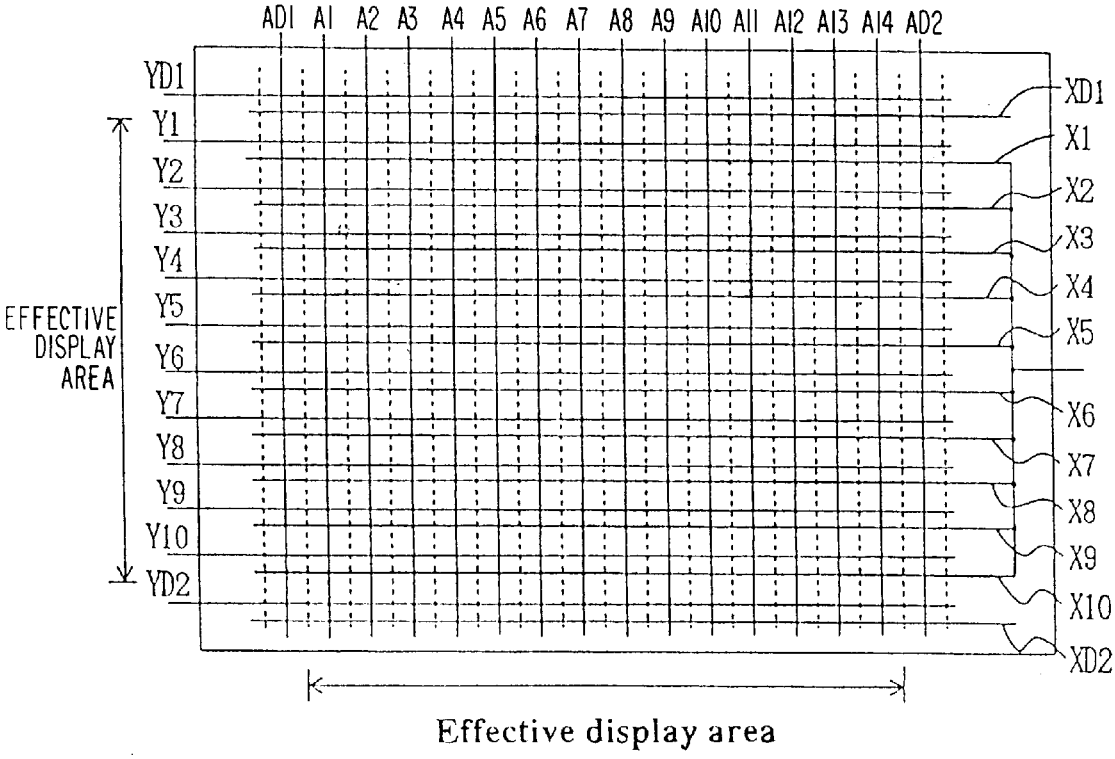
FIG. 3 is a plan view of the three-electrode-surface-discharge AC plasma display panel, showing the relationship between pairs of display electrodes (X and Y electrodes) and address electrodes.

FIG. 3 shows the relationship between pairs of the X and Y electrodes and the address electrodes in the three-electrode-surface-discharge AC plasma display panel. As shown in FIG. 3, X electrodes X1~X10 extend horizontally parallel to each other, and are connected in common to each other on an end of the glass substrate 10, and Y electrodes Y1~Y10 are positioned between the X electrodes X1~X10 and have respective ends projecting from an opposite end of the glass substrate 10. These X and Y electrodes X1~X10, Y1~Y10 are combined in pairs which serve as display lines, and a sustain discharge voltage is applied alternately to the pairs of X and Y electrodes for displaying an image on the three-electrode-surface-discharge AC plasma display panel. The X and Y electrodes X1~X10, Y1~Y10 are positioned in an effective display area on the glass substrate 10. Dummy electrodes XD1, XD2, YD1, YD2 are positioned outside of the effective display area on the glass substrate 10 for lessening nonlinear properties in a peripheral edge region of the plasma display panel. Address electrodes A1~A14 on the glass substrate 20 extend perpendicularly to the X and Y electrodes X1~X10 , Y1~Y10.

While the X and Y electrodes are combined in pairs to which a sustain discharge voltage is applied alternately, the Y electrodes also serve as scan electrodes for writing information. The address electrodes are also used for writing information. A plasma discharge is produced between an address electrode and a Y electrode to be scanned according to information that is to be written. Therefore, only a discharge current for only one cell is required to flow in each of the address electrodes. Since a discharge voltage applied to each of the address electrodes is determined depending on its combination with a Y electrode, the address electrodes can be driven with a relatively low voltage. Such a low current and a low voltage for driving allows the plasma display panel to display images on a large screen.

Figure 4:
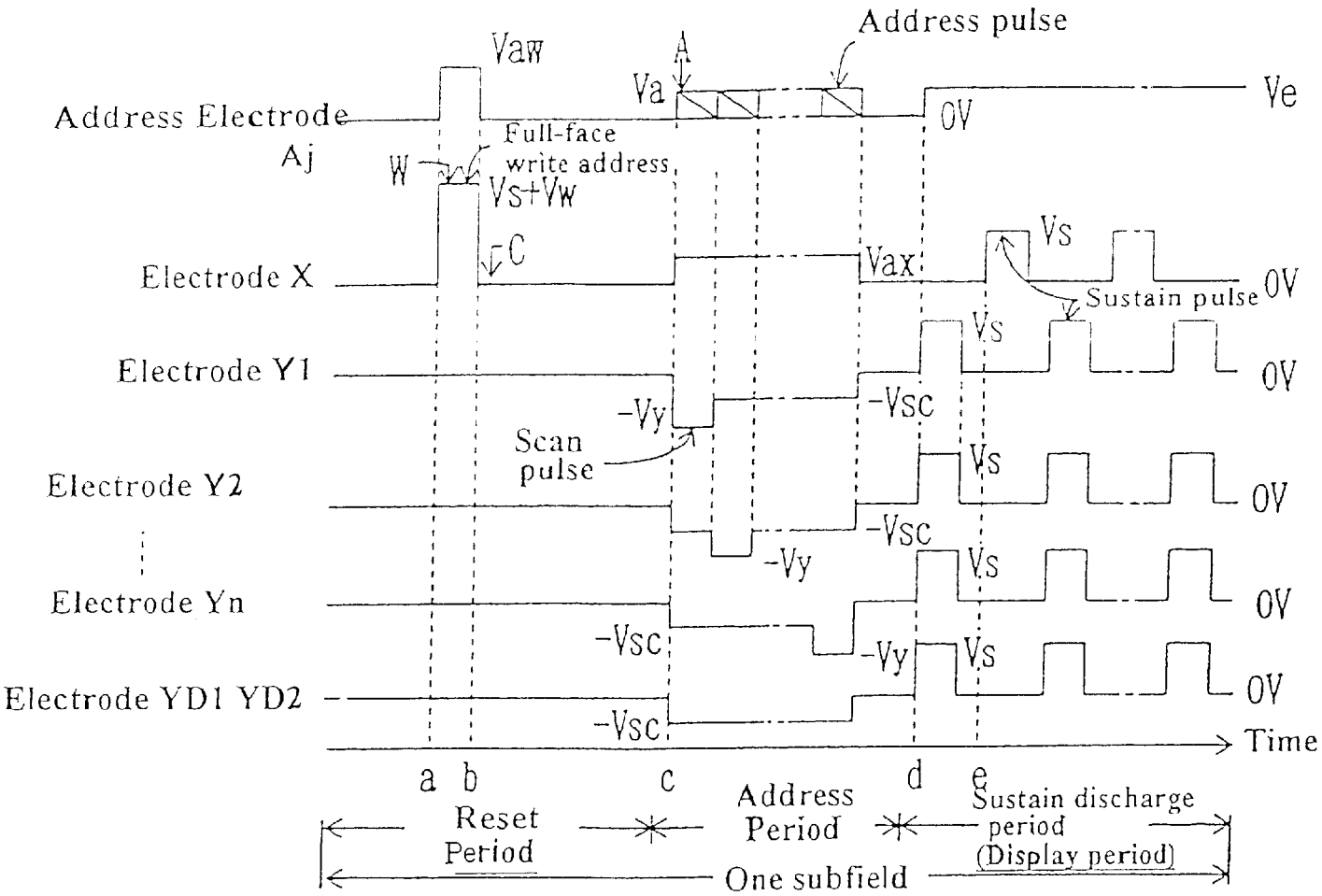
FIG. 4 is a diagram of the waveforms of voltages applied to the electrodes, illustrating a specific process of operating the plasma display panel.

FIG. 4 illustrates the waveforms of voltages applied to the electrodes, illustrating a specific process of driving the plasma display panel. In FIG. 4, voltages applied to the electrodes are specifically Vw=130 V, Vs=180 V, Va=50 V, −Vsc=−50 V, −Vy=−150 V, for example. Voltages Vaw, Vax are set to intermediate potential levels of voltages applied to other electrodes.

In the driving of the three-electrode-surface-discharge AC plasma display panel, one subfield comprises a reset period, an address period, and a sustain discharge period (display period).

In the reset period, a full-face write pulse is applied to the commonly connected X electrodes between times a–b, producing a discharge between the X and Y electrodes fully over the plasma display panel. Of charges generated in the spaces 25 by the discharge, positive charges are attracted to the Y electrodes under a low voltage, and negative charges are attracted to the X electrodes under a high voltage. As a result, at the time b when the write pulse falls to zero, a discharge is produced again by a high electric field that is developed due to the charges attracted between the X and Y electrodes and stored on the dielectric layer 14 (at C in FIG. 4). Consequently, the charges on all the X and Y electrodes are neutralized, completing the resetting of the plasma display panel. A period between times b–c is a time required to neutralize the charges.

In the address period, the voltage of −50 V (−Vsc) is applied to the Y electrodes and the voltage of 50 V (Va) is applied to the X electrodes. While a scan pulse of the voltage of −150 V (−Vy) is being applied successively to the Y electrodes, an address pulse of the voltage of 50 V (Va)

according to display information is applied to the address electrodes. As a result, a large voltage of 200 V is applied between the address electrodes and the scan electrodes, producing a plasma discharge. Since the voltage and the duration of the pulses are not so large as those of the full-face write pulse applied for resetting the plasma display panel, an opposite discharge due to stored charges is not produced when the application of the pulses is finished. of space charges generated by the discharge, negative charges are stored on the dielectric layers 14, 22 at the X electrodes to which the voltage of 50 V is applied and the address electrodes, and positive charges are stored on the dielectric layer 14 at the Y electrodes to which the voltage of −50 V is applied.

The above storage of charges can better be understood from FIGS. 5A through 5D which are illustrative of a random discharge. The charges thus generated and stored over the X and Y electrodes perform a memory function for a sustain discharge in a subsequent sustain discharge period. Specifically, when a subsequent sustain discharge voltage is applied between the X and Y electrodes, the sustain pulse voltage and the voltage of a stored charge are superposed between the X and Y electrodes of those cells where the charge has been stored due to the discharge in the address period, causing a sustain discharge between the X and Y electrodes.

Figure 5A:
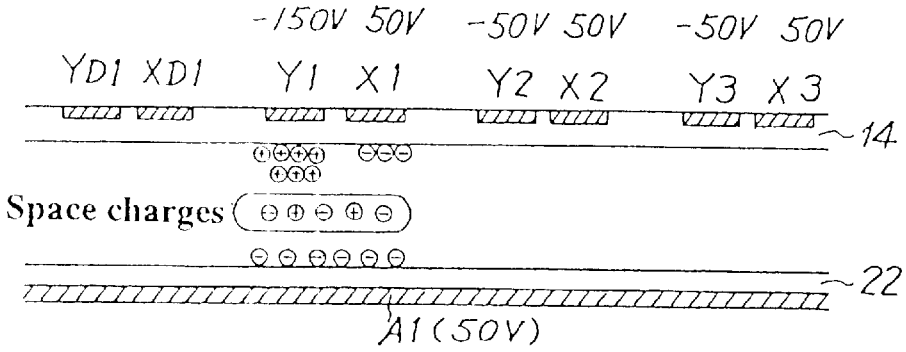
FIGS. 5A through 5D are cross-sectional views illustrative of a random discharge.
Figure 5B:
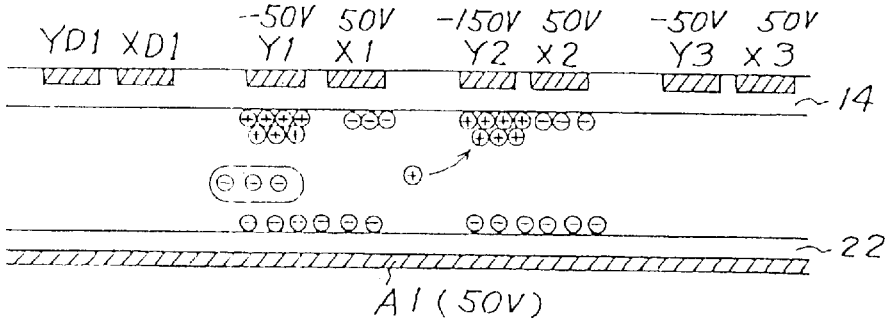
Figure 5C:
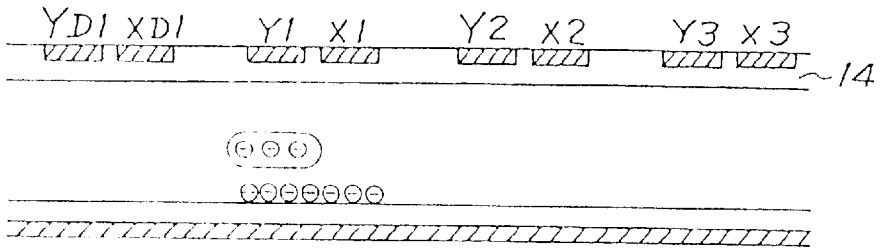
Figure 5D:
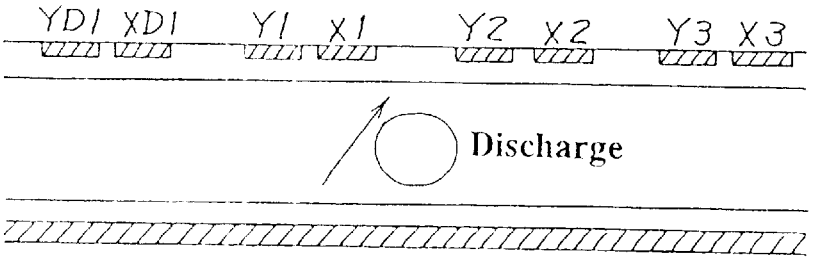

As the scan pulse having the voltage of −Vy moves through the Y electrodes, positive charges, for example, of the space charges move to the left in FIGS. 5A through 5D, whereas negative charges thereof move to the right in FIGS. 5A through 5D, until they are stored respectively on the opposite ends of the plasma display panel. Those charges over the address electrode which are not utilized for the memory function are not discharged in the subsequent sustain discharge period, but stored as shown in FIG. 5C and cause a random discharge as shown in FIG. 5D.

In the sustain discharge period, finally, a display discharge depending on the luminance of an image to be displayed is brought about using the wall charges stored in the address period. Specifically, a sustain pulse having such a magnitude which will cause a discharge in those cells having wall charges and will not cause a discharge in those cells free of wall charges is applied between the X and Y electrodes. As a result, a discharge is repeated alternately between the X and Y electrodes in those cells which have stored wall charges in the address period. The luminance of an image to be displayed is represented by the number of repeated discharge pulses. Therefore, an image can be displayed in multiple gradations by repeating the subfield in the sustain discharge period which has been weighted a plurality of times. It is possible to display a full-color image with a combination of R, G, B cells.

As shown in FIGS. 5A through 5D, wall discharges are stored on the dielectric layer 14 on the X and Y electrodes and utilized for a discharge in the sustain discharge period. However, charges on the dielectric layer 22 on the address electrodes are not utilized for such a purpose. There are no positive reasons for keeping such a large amount of charges stored on the dielectric layer 22. Rather, a large amount of charges stored on the dielectric layer 22 is responsible for a random discharge as shown in FIG. 5D.

According to the present invention, charges stored on the address electrodes are allowed to leak at a low rate to prevent charges from being stored on the address electrodes to an amount large enough to initiate a random discharge. Specifically, a small amount of electrically conductive material is mixed into the dielectric layer 22 which covers the address electrodes to make the dielectric layer 22 electrically conductive so as to leak the charges or to make the resistance of the dielectric layer 22 so lower to leak the charges. As a result, charges are prevented from being stored on the dielectric layer 22 to an amount large enough to initiate a random discharge. In this case, an isolation between the address electrodes should be maintained high enough.

Figure 6:
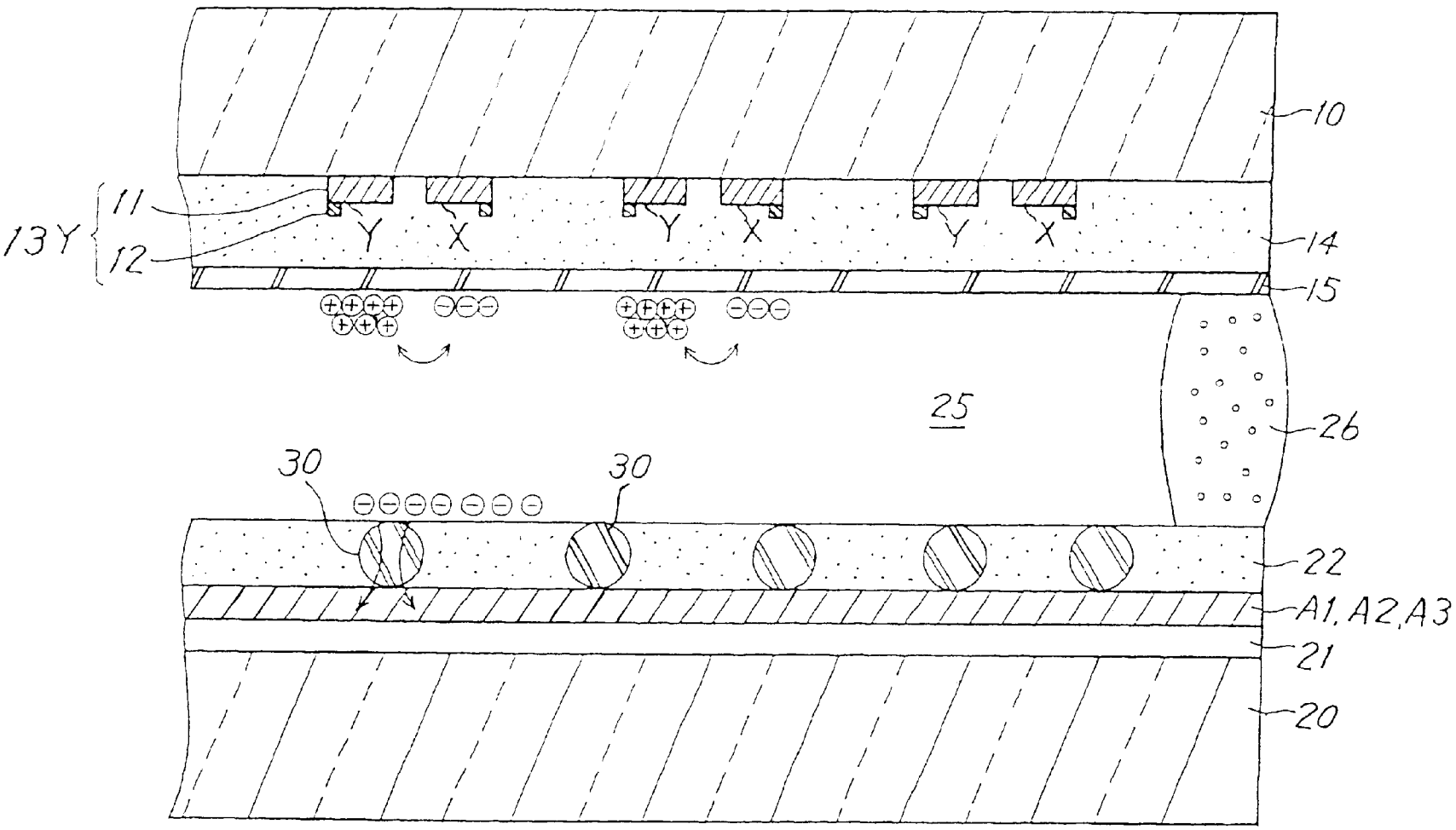
FIG. 6 is an enlarged fragmentary cross-sectional view of the plasma display panel, showing a dielectric layer mixed with an electrically conductive material.
Figure 7:
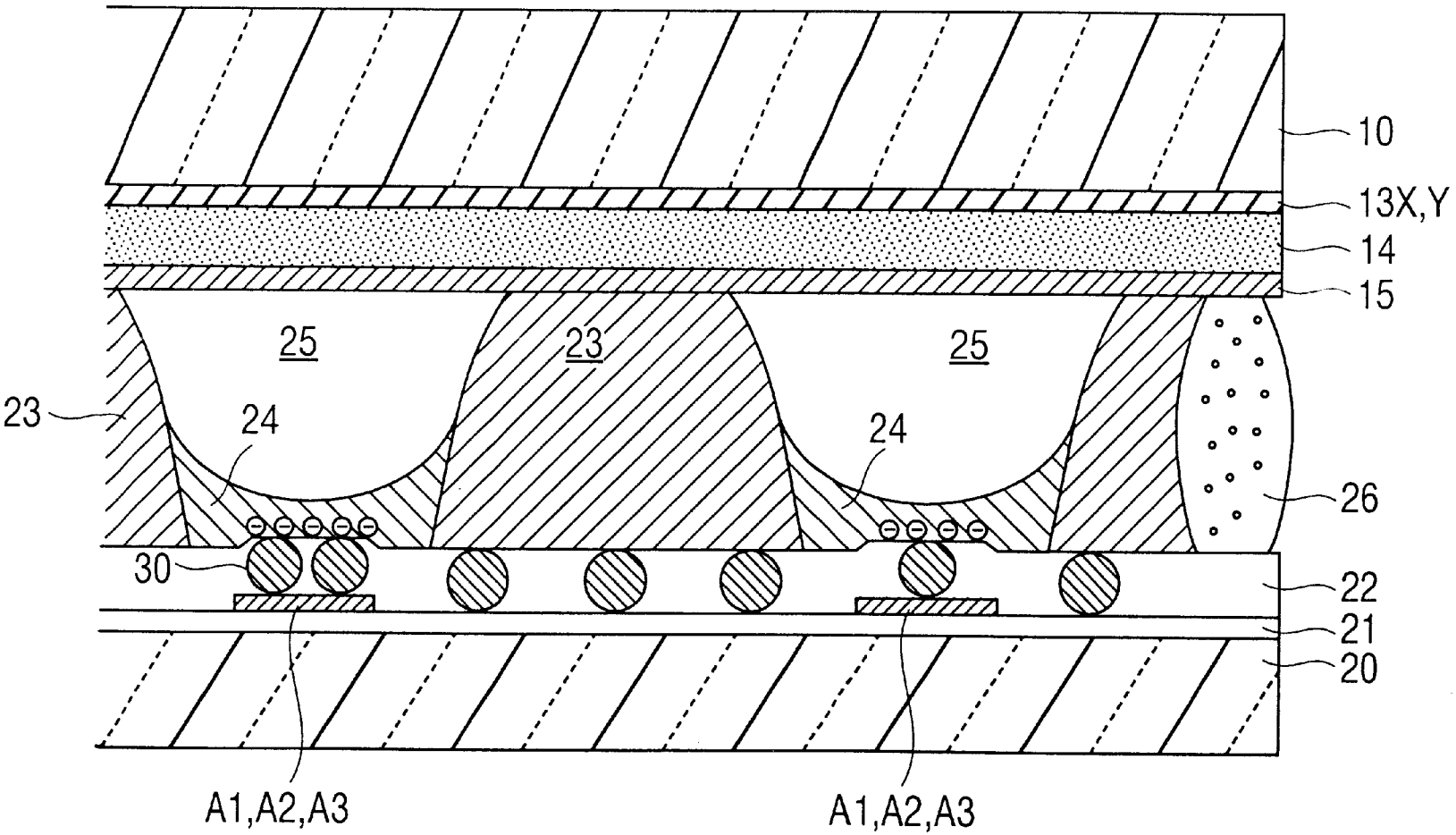
FIG. 7 is an enlarged fragmentary cross-sectional view of the plasma display panel, showing the dielectric layer mixed with the electrically conductive material.

FIGS. 6 and 7 show the plasma display panel, showing the dielectric layer 22 mixed with an electrically conductive material. FIG. 6 is a cross-sectional view taken along the address electrodes A1, A2, A3, and FIG. 7 is a cross-sectional view taken along the X and Y electrodes. Those parts shown in FIGS. 6 and 7 which are identical to those shown in FIG. 1 are denoted by identical reference characters. The dielectric layer 22 disposed over the address electrodes A1~A3 is mixed with particles 30 of electrically conductive material. Therefore, while the dielectric layer 22, which is made of glass of low melting point that is primarily composed of lead oxide (PbO), keeps its properties as a dielectric material, it also exhibits electric conductivity in its transverse direction. As a consequence, charges stored on the dielectric layer 22 leak at a low rate to the address electrodes through the mixed particles 30 electrically conductive material at all times. The phosphor layers 24 shown in FIG. 7 comprise porous films which permit charges to be stored essentially on the dielectric layer 22.

A diameter of these electrically conductive material is preferably within a range of average diameter(D50) explained later. Although the size of the particles 30 in FIGS. 6 and 7 are shown to be almost equal to the thickness of the dielectric layer 22 illustratively, since a resistance through the dielectric layer 22 would be lower with smaller diameters of particles 30 than the thickness, the diameter can be smaller than the thickness. When the particles 30 of electrically conductive material with a diameter explained later are mixed in an amount which falls in a suitable range, the particles 30 of electrically conductive material are placed over the address electrodes at an appropriate density without impairing the original functions of the dielectric layer 22. Basically, it is not preferable to mix the particles 30 of electrically conductive material at a density large enough to cause a leakage of charges between adjacent address electrodes. The peripheral edges of the glass substrates 10, 20 are sealed by a sealing layer 26 of glass of low melting point which is primarily composed of lead oxide. Therefore, it is not preferable either to mix a large amount of particles 30 of electrically conductive material with the dielectric layer 22 thereby to lower the denseness of the dielectric layer 22 and hence allow an introduced gas to leak therefrom. Nevertheless, it is necessary to mix the particles 30 of electrically conductive material in an amount large enough to bring about a leakage of charges from the dielectric layer 22 for the purpose of preventing a random discharge.

The inventors produced samples A, B, C of 42-inch random display panels whose dielectric layers 22 were mixed and not mixed with electrically conductive particles, and measured the number of times that random discharges occurred on the samples A, B, C. The results of the experiment are shown in Table below.

TABLE

| Sample | Ratio of weight % of mixed materials of dielectric layer (PbO:Cr) | Number of times that random discharges occurred per minute |
|---|---|---|
| PDP A | 100:1 | 0 |
| PDP B | 100:5 | 0 |
| PDP C | No Cr mixed | 13 |

In the sample A, the dielectric layer 22 had a thickness of about 10 μm, and was produced by mixing particles of chromium (Cr) having a particle diameter of about 10 μm with lead oxide (PbO) at a ratio of 100:1 in terms of weight %. The number of times that random discharges occurred on the sample A per minute was 0, whereas the number of times that random discharges occurred on the sample C, which had no particles of chromium mixed, per minute was 13. In the sample B, the dielectric layer 22 was produced by mixing particles of chromium (Cr) with lead oxide (PbO) at a ratio of 100:5 in terms of weight %. The number of times that random discharges occurred on the sample B per minute was also 0.

The above experimental results do not guarantee that no random discharges occur on the samples A, B in a very long time span. However, the fact that the samples A, B had suffered no random discharges whereas 13 random discharges were observed on the sample C which was free of electrically conductive particles indicates that it is possible to greatly reduce the frequency of random discharges by mixing electrically conductive particles.

In view of the fact that lead oxide has a specific gravity of 5.5, the dielectric layer 22 has a thickness of 10 μm, chromium has a specific gravity of 7.20, and the particles of chromium have a diameter of 10 μm, the ratio of 100:1 of weight % of the materials of the dielectric layer 22 of the sample A shows that about one particle of chromium is present in the dielectric layer 22 in the form of a rectangular parallelepiped having sides each 80 m long (see FIG. 10), which is equal to the width of each address electrode, and the ratio of 100:5 of weight % of the materials of the dielectric layer 22 of the sample B shows that about five particles of chromium are present in the dielectric layer 22 in the form of a rectangular parallelepiped having sides each 80 μm long.

Figure 8:
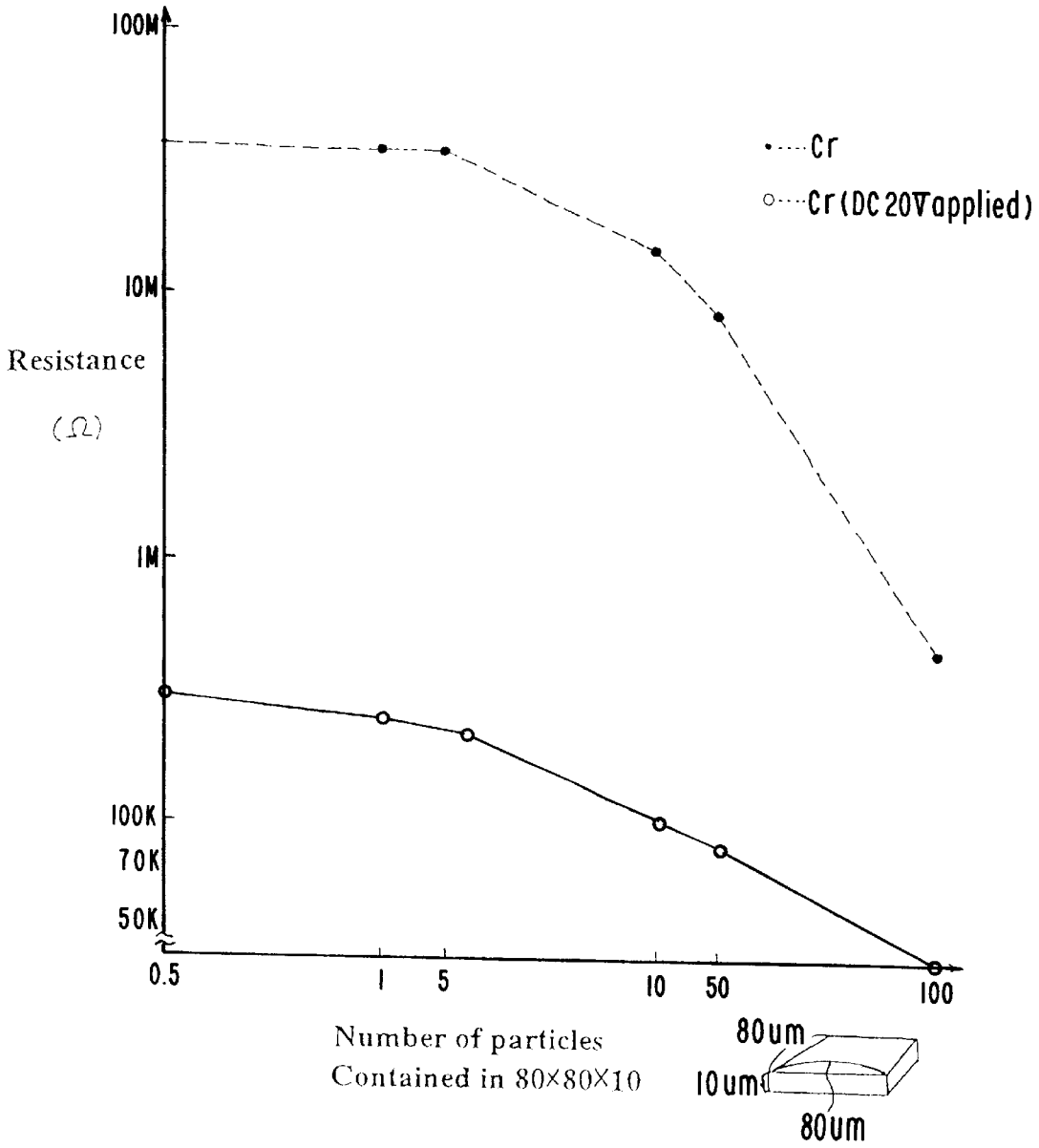
FIG. 8 is a graph showing the results of an experiment.
Figure 9:
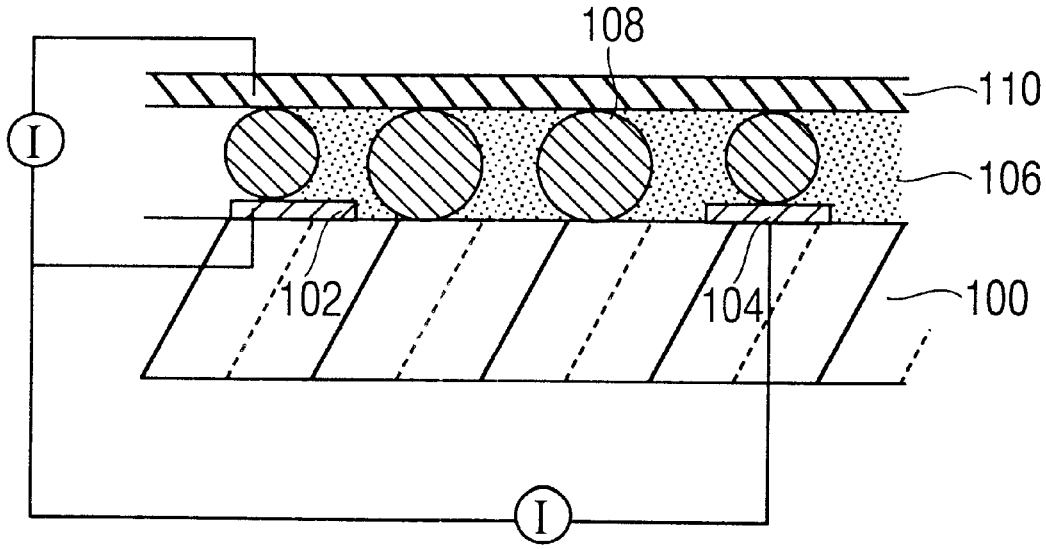
FIG. 9 is a fragmentary cross-sectional view of a sample used in the experiment.

FIG. 8 shows graph showing the results of another experiment conducted on a sample shown in FIG. 9 by the inventors. The experiment was carried out in order to inspect the electric conductivity in the transverse direction of a dielectric layer 106 (see FIG. 9) mixed with electrically conductive particles of chromium or the like. As shown in FIG. 9, the sample had a glass substrate 100, electrode layers 102, 104 of three-layer structure (Cr/Cu/C) disposed on the glass substrate 100 each having a width of about 80 μm and spaced from each other by a distance of about 280 μm, a dielectric layer 106 of lead oxide mixed with particles 108 of chromium (Cr) having a diameter of about 10 μm, the dielectric layer 106 being disposed on the glass substrate 100 in covering relation to the electrode layers 102, 104 and having a thickness of about 10 μm, and a layer 100 of silver (Ag) paste disposed on the dielectric layer 106. The resistance between the silver paste layer 100 and the electrode layer 102 was measured.

FIG. 8 shows measured values of the resistance between the silver paste layer 100 and the electrode layer 102 with respect to samples with various numbers of particles 108 of chromium contained in the dielectric layer 106. In FIG. 8, solid dots indicate measured values of the resistance of the samples in which the dielectric layer 106 containing particles 108 of chromium was formed by screen printing and baked, and the silver paste layer 110 was formed on the dielectric layer 106 thus formed, whereas blank dots indicate measured values of the resistance of the same samples after a DC voltage of about 20 V was applied between the silver paste layer 100 and the electrode layer 102. When the dielectric layer 106 containing particles 108 of chromium was baked, very thin layers of glass of low melting point were present on the surfaces of the particles of chromium, making the resistance between the silver paste layer 100 and the Cu layer 102 relatively high as indicated by the solid dots in FIG. 8. However, when the DC voltage of about 20 V was applied between the silver paste layer 100 and the electrode layer 102, it is suspected that such very thin layers of glass of low melting point were broken, resulting in highly reduced values of the resistance as indicated by the blank dots in FIG. 8.

Figure 10:
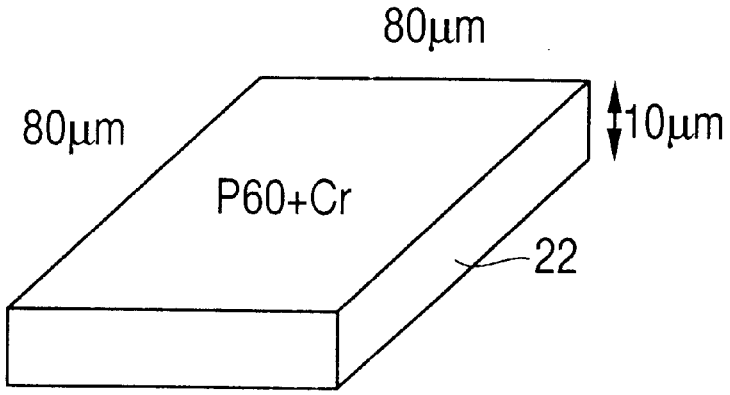
FIG. 10 is a perspective view of the dielectric layer in the form of a rectangular parallelepiped having sides each 80 μm long.

It can be seen from the experimental results shown in FIG. 8 that if 1 to 100 particles of chromium having substantially the similar diameter as the thickness of the dielectric layer are contained in the rectangular parallelepiped shown in FIG. 10, then the dielectric layer allows a leakage of discharges in the transverse direction thereof while maintaining a certain resistance. If the dielectric layer contained too many particles, then the denseness of the dielectric layer would be lowered, impairing the sealing capability at its peripheral edges.

While the particles mixed with the dielectric layer have been illustrated as being made of chromium, they may be made of a metal such as nickel (Ni) or the like which is hardly oxidizable. The particles should be made of a hardly oxidizable metal because if the surfaces of the particles were oxidized when the dielectric layer is baked, then the oxidized surfaces of the particles would prevent the dielectric layer from allowing a leakage of charges.

A method of manufacturing the plasma display panel will be described below. First, the fabrication of the assembly which includes the glass substrate 20 will be described below. Since the fabrication process itself is relatively simple, it will be described with reference to FIGS. 6 and 7.

First, after the surface of a glass substrate 20 is cleaned, a passivation base film 21 is formed by screen printing and baked on the glass substrate 20. Then, an address electrode layer of three-layer structure (Cr/Cu/Cr) is deposited to a thickness of about 1 μm on the passivation base film 21 by a thick film process, and thereafter patterned into address electrodes A1~A3 by ordinary photolithography and sputtering.

A paste of glass of low melting point which is primarily composed of lead oxide mixed with electrically conductive particles of chromium or the like is coated on the passivation base film 21 in covering relation to the address electrodes A1~A3 by screen printing, thus forming a dielectric layer 22. Specifically, the electrically conductive particles should preferably have an average diameter within a range explained later. To obtain such particles, particles of chromium are sieved with a mesh screen having a predetermined mesh size, and then sieved with a mesh screen having a smaller mesh size than the above. Those particles of chromium which have not passed through the mesh screen having the smaller mesh size are used as particles to be mixed with the paste of glass. The obtained particles of chromium are then mixed with a paste of glass of low melting point at a ratio of 100:1~5 in terms of weight %, after which they are blended for about an hour. The glass paste mixed with the particles of chromium is coated on the passivation base film 21 in covering relation to the address electrodes A1~A3 by screen printing, and then baked at a temperature ranging from 580 to 590° C. for about 60 minutes, producing a dielectric layer 22 having a thickness of about 10 $\mu$m.

To form ribs 23, a paste of glass of low melting point is deposited to a thickness of about 200 m on the dielectric layer 22 by screen printing. After the glass paste is dried, it is processed into ribs 23 by a sandblasting process. In the sandblasting process, a dry film is applied to the surface of the dried glass paste, and exposed to a predetermined pattern and developed, after which an abrasive material is blown by an air nozzle through the patterned dry film as a mask to the glass paste so as to etch the glass paste off. Thereafter, the dry film is removed, and the glass paste is baked.

Thereafter, a phosphor material is coated between the ribs 23 to produce phosphor layers 24. The assembly which includes the glass substrate 20 is thus fabricated.

The assembly which includes the glass substrate 10 at back side will be fabricated as follows:

A transparent electrically conductive film of indium tin oxide (ITO) is deposited on a glass substrate 10 and patterned into transparent electrodes 11 by photolithography. Then, an electrically conductive film of three-layer structure (Cr/Cu/Cr) is deposited on the transparent electrodes 11 and patterned into bus electrodes 12 by photolithography. Thereafter, a dielectric layer 14 is deposited on the glass substrate 10 in covering relation to the transparent electrodes 11 and the bus electrodes 12 by printing, and then baked. Then, a sealing layer 26 of glass of low melting point is formed on the peripheral edge of the assembly, and a protective layer of MgO 15 is deposited on the dielectric layer 14 by evaporation. The assembly which includes the glass substrate 10 is thus fabricated.

Thereafter, both the assemblies are combined with each other and sealed with respect to each other. The combined assemblies are then evacuated, and filled with a discharge gas of Ne and Xe. The fabrication of the plasma display panel is now completed.

Therefore, the plasma display panel according to the present invention can be manufactured substantially in the same manner as conventional plasma display panels.

The dielectric layer 22 which covers the address electrodes may be produced by evaporation or the like using a source including a metal material for controlling the resistance.

In the above embodiment, the metal particles, such as chromium Cr or nickel Ni, which is hardly oxidized, are mixed in the dielectric layer 22. However, the present invention is not limited to such metal materials. Particles of conductive oxide material may be mixed in the dielectric layer 22. The dielectric layer 22 itself is the glass layer which includes lead oxide, PbO, as main material. Further, the dielectric layer 22 is formed in the production process by printing a glass paste layer on the substrate and being baked. Since the baking step is performed in an air atmosphere with 500–600 degrees centigrade, the surface of the metal particles may be oxidized through the baking condition so that the conductivity of the dielectric layer for allowing the stored charge leak may be lost.

Furthermore, the conductive particles are surrounded by the glass layer 22 and expected to be oxidized further by an increase of temperature through driving the panel. This may also lead a reduction of the conductivity of the particles. And such oxidation is not repeatable phenomenon with unstable factors.

In another embodiment of the present invention, a conductive oxide materials are used as the conductive particles mixed in the dielectric layer 22. An example of such conductive oxide materials is preferably a semiconductor material which is a metal oxide, i.g. indium oxide ($In_2O_3$), tin oxide ($SnO_2$), titanium oxide ($TiO_2$) or the like, which is doped with impurities. In case where such conductive oxide is mixed in the dielectric layer, although such particles are mixed in the low melting point glass paste and baked, since the particles are oxide material, therefore, the conductivity thereof will not be changed by further oxidization.

Figure 11:
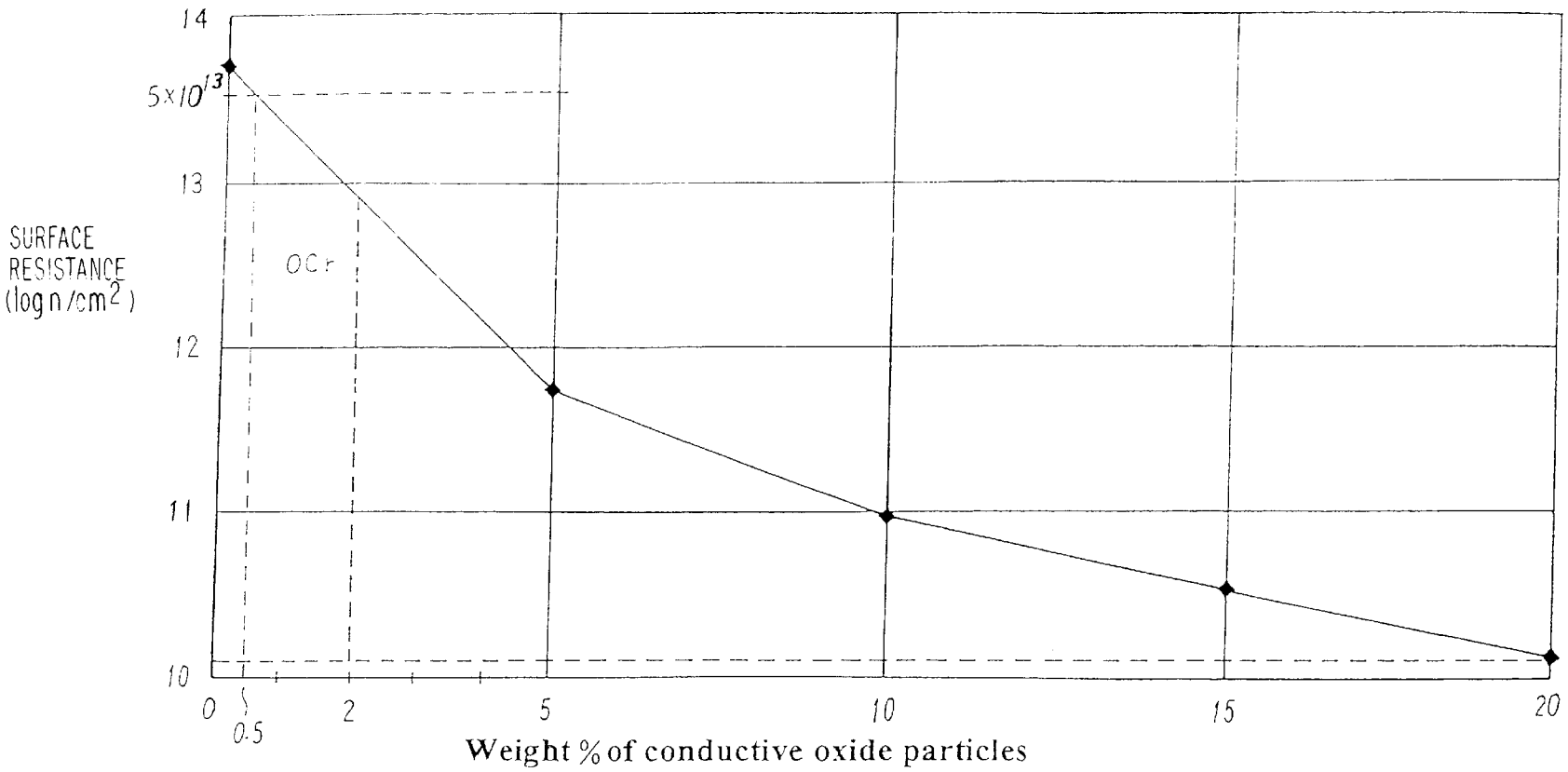
FIG. 11 is a drawing to show a relationship between a weight % of indium oxide, $In_2O_3$ particles to a layer which is made of dielectric material of $PbO—SiO_2—B_2O_3$ system mixed with the indium oxide particles and a surface resistance.

FIG. 11 is a drawing to show a relationship between a weight % of indium oxide, $In_2O_3$, particles to a layer which is made of dielectric material of PbO—$SiO_2$—$B_2O_3$ system mixed with the indium oxide particles and a surface resistance. In this sample, the dielectric layer with about 10 micro-meter is formed by being mixed with particle having an average diameter of several micro-meter and baked in the above temperature. The graph in FIG. 11 shows a result in which a surface resistance of each samples is measured by changing the weight % of the particle. Further, a surface resistance of an sample mixed with 1 wt % chromium Cr particles explained later is added as an reference value in the graph.

As clear from the graph, it is preferable for decreasing a frequency of the random discharge and for avoiding the latch-up phenomenon caused by the discharge to control the weight percentage of the conductive oxide material so that the surface resistance thereof is the same level as the sample mixed with chromium Cr particles. In case of indium oxide, $In_2O_3$, particles, a range of inclusion ratio 0.5–20 wt % yields a range of surface resistance $5\times10^{13}$–$1\times10^{10}$ $\Omega/cm^2$. As understood from the graph, it is a problem to have too low conductivity in order to electrically isolate between the address electrodes. Further, if the inclusion ratio is too high so as to reduce the surface resistance, the melting point of the glass paste becomes high so that the baking temperature becomes high and it tends to be difficult to bake it properly. Therefore, 20 wt % is the upper value for the inclusion ratio. On the other hand, the bottom value for the inclusion ratio is about 5 wt % at which the surface resistance is not so high that the dielectric material allows the stored charges to leak in some extent thereby reducing the number of the random discharge and avoiding hardware failure by the random discharge.

Further preferable range is 2–10 wt % of inclusion ratio of the particles and $1\times10^{13}$–$1\times10^{11}$ $\Omega/cm^2$. Further preferable range is 4–10 wt % and $1\times10^{12}$–$1\times10^{11}$ $\Omega/cm^2$.

The inclusion ratio of the particles and the surface resistance of the dielectric layer including the particles does not necessarily correspond one to one. For example, the relationship thereof changes depending on the amount of doped impurities of the metal oxide material. However, the above preferable range for the surface resistance is the range in which the conflicting functions for the dielectric layer, the isolation and the leaking effect of the accumulated charges otherwise causing a random discharge, can be realized simultaneously. Also, the above preferable range of the particles inclusion ratio is the range in which the same functions can be given to the dielectric layer without increasing the baking temperature.

As explained above, the diameter of the conductive oxide material particles are selected to be several micro-meter in its average diameter. Therefore, large amount of particles smaller than the thickness are buried in the dielectric layer with about 10 micro-meter thickness. However, even though the dielectric layer is high resistance, the total resistance through the thickness direction of the dielectric layer with mixing the low resistance particles therein is lower than that of the dielectric layer without mixing such particles. On the other hand, in case where too many particles having diameters larger than the thickness of the dielectric layer are mixed in the dielectric layer, such large particles projecting over the surface of the dielectric layer may have a function as electrodes for discharge because of an electric field concentration thereof. Therefore, the average diameter of the particles may be preferable to be smaller than the thickness of the dielectric layer.

Figure 12:
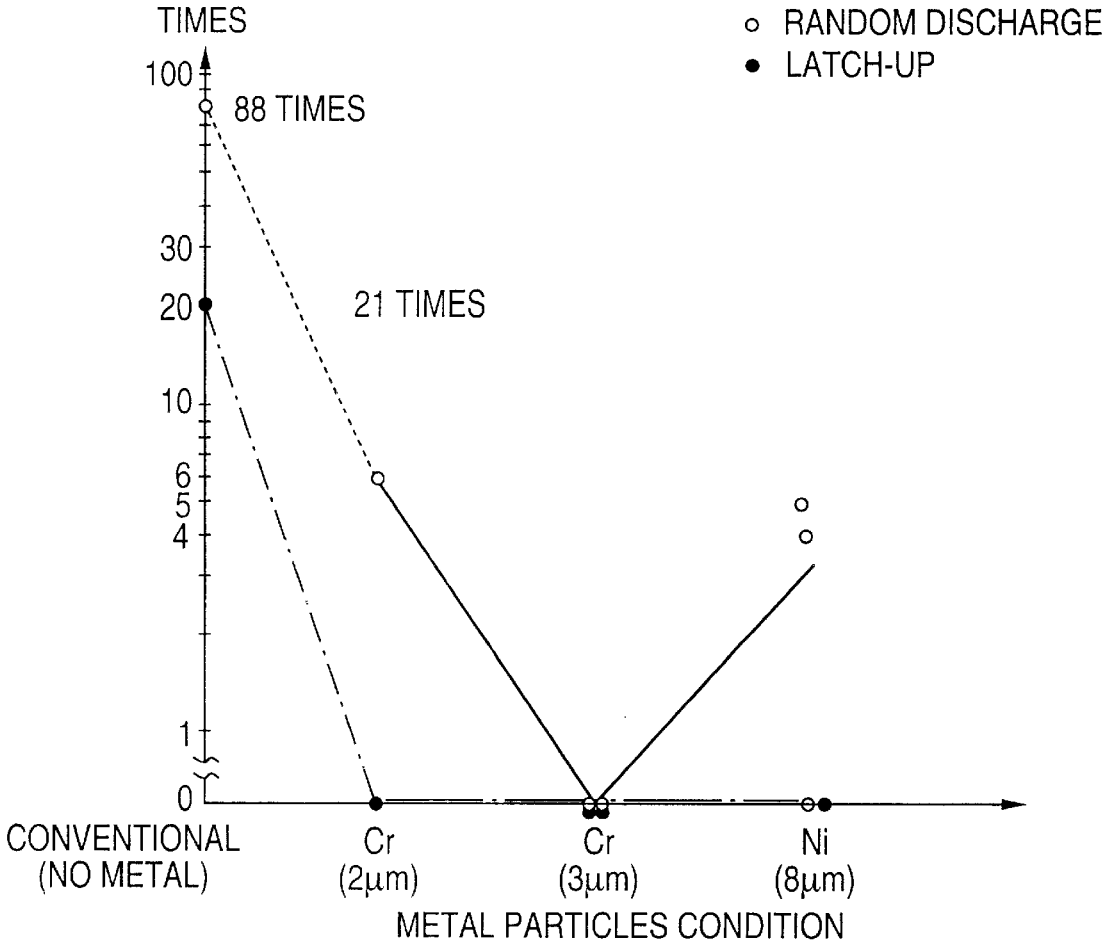
FIG. 12 is a drawing to show an evaluation result of a plasma display panel having a dielectric layer which includes metal particles therein as a first embodiment.

FIG. 12 is a drawing to show an evaluation result of a plasma display panel having a dielectric layer which includes metal particles therein as a concrete embodiment. The samples are 42 inches plasma display panel, one of these having a dielectric layer including chromium, Cr, particles with 2 micro-meter average diameter, D50, two of these having a dielectric layer including chromium, Cr, particles with 3 micro-meter average diameter, D50, and three of these having a dielectric layer including nickel, Ni, particles with 8 micro-meter average diameter, D50. Each of them has about 1 wt % inclusion ratio of the particles. Evaluated values shown in FIG. 12, number of random discharge per minute when 400 lines are lighted, i.e. white circles in the drawing, and number of latch-up per 10 minutes when 400 lines are lighted, i.e. black circles in the drawing. The horizontal axis is given the average diameter of particles whereas the vertical axis is given the numbers thereof. Further, each number of a sample without having such conductive particles is added as a conventional one for a comparative reference.

These evaluation result yields a conclusion that in the range of average diameter 2–6 $\mu$m, the latch-up phenomenon which is happen in the sample without conductive particles almost disappears. Further, in the range of average diameter 2–6 $\mu$m, the random discharge phenomenon which is happen in the sample without conductive particles is reduced substantially. It is thought that the latch-up phenomenon means a large discharge phenomenon caused by an accumulated charge on the dielectric layer over the address electrodes which occurs generally along the address electrodes, causing a malfunction of the address electrodes and destruction of the hardware. Therefore, such phenomenon is necessary to be avoided. The random discharge is a relatively smaller discharge than the latch-up which causes deterioration of display condition, therefore, is necessary to be reduced as least as possible.

The average diameter shown in FIG. 12 is the result in which mixing particles are measured by a laser diameter distribution measurement apparatus of Helos & Rodos. One of the ordinary method for controlling diameters of particles is to be sieved through a mesh screen having a predetermined mesh size. Therefore, the diameters of particles have a dispersion in some extent. That is, in particles with 3 micro-meter average diameter, particles having diameters more than 10 micro-meter, thickness of the dielectric layer, may exist and particles having diameters less than 3 micro-meter may exist as well. Although the diameter of the conductive particles is smaller than the thickness of the dielectric layer, the total resistance through the thickness of the dielectric layer can be reduced so that the accumulated charges can leak the dielectric layer as explained above.

Figure 13:
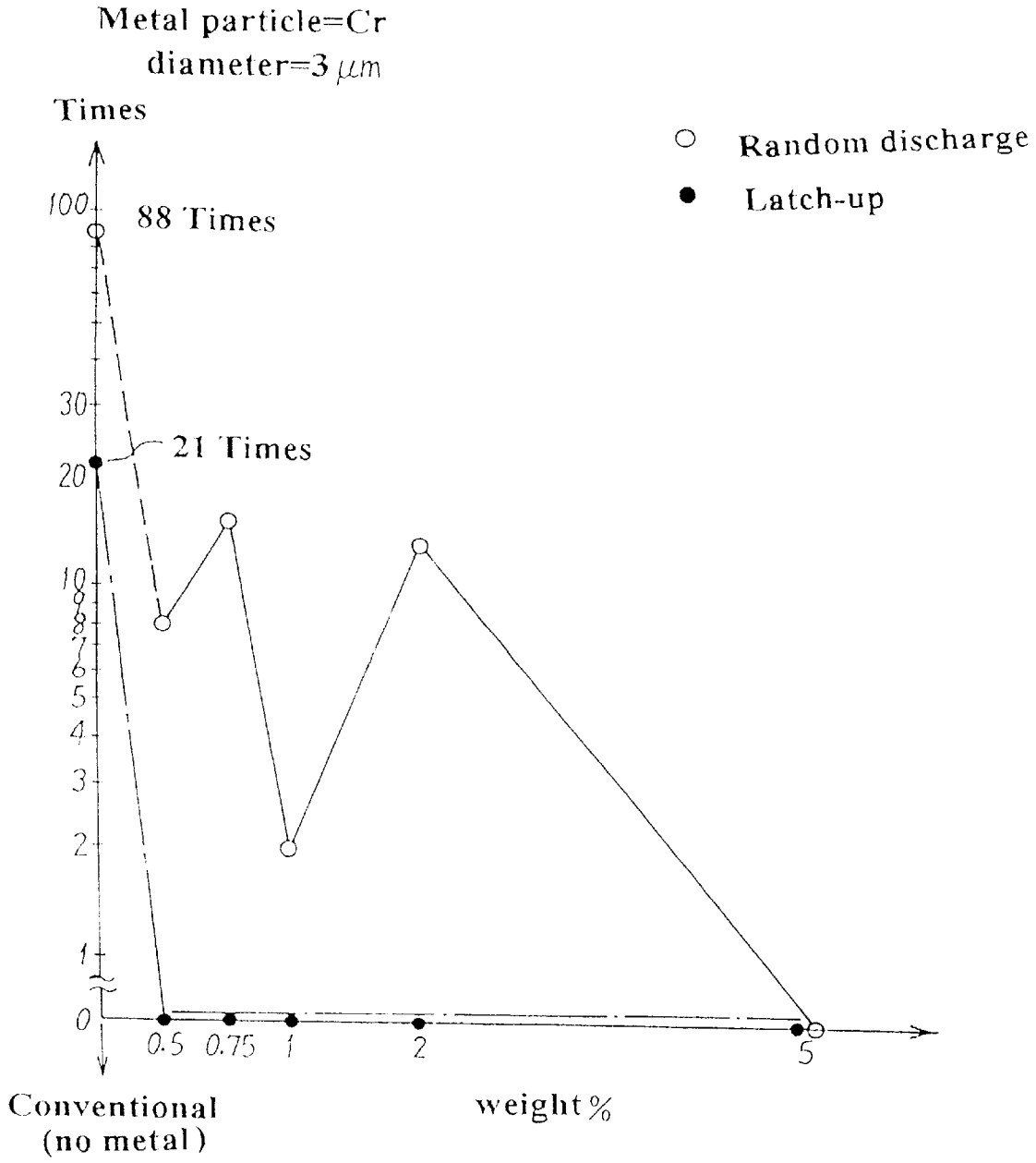
FIG. 13 is a drawing to show a evaluation result of a plasma display panel having a dielectric layer which includes metal particles therein as a second embodiment.

FIG. 13 is a drawing to show an evaluation result of a plasma display panel having a dielectric layer which includes metal particles therein as another concrete embodiment. This embodiment is 42 inches PDP samples which have an dielectric layer mixed with Chromium Cr particles having about 3 micro-meter average diameter, more strictly 2.86 micro-meter. Each inclusion ratio of the particles for the samples is 0.5, 0.75, 1.0, 2.0 and 5.0 wt %. The horizontal axis is given the inclusion ratio and the vertical axis is given number of the random discharge per minute as white circles and number of the latch-up per 10 minutes as black circles. A sample without conductive particles is added as a conventional reference.

As understood from the graph in FIG. 13, in the range of the inclusion ratio of the particles 0.5–5 wt %, the latch-up phenomenon which occurs in the conventional sample does not occur. In the range of the inclusion ratio of the particles 0.5–5 wt %, the random discharge which occurs frequently in the conventional sample is reduced very much.

For the five samples in the above embodiment, a margin of a pulse voltage applied to scan electrodes, Y electrodes, during address period is also evaluated. The voltage Vy in the address period shown in FIG. 4 is a scan pulse voltage applied to the Y electrodes to discharge in the address period. When the voltage Vy is too low, such discharge can not generate enough charges for the subsequent sustain discharge. On the other hand, when the voltage Vy is too high, a reset discharge occurring at the falling edge of the pulse signal may delete the generated charges so that the following sustain discharge can not occur. This is the margin of the scan pulse voltage Vy. It is found that the sample with 5 wt % has relatively narrow margin for the scan pulse voltage Vy. Therefore, the inclusion ratio of the particles may be preferably 0.5–2.0 wt %.

As explained above in the concrete embodiment, the resistance of the dielectric layer 22 on the address electrodes reduces comparing to a dielectric layer without such conductive particles, by being mixed with metal particles or conductive oxide material particles. And such reduced resistance is capable to leak the accumulated charges on the dielectric layer appropriately which cause random discharge or latch-up. Further, when the average diameter and the inclusion ratio of the particles are set into the above preferable range, there is no specific difference with respect to the baking process of the dielectric layer. And the quality or density of the dielectric layer can be maintained to be good enough to seal the discharge gas.

Furthermore, according to the present invention, as clearly shown in the above evaluation result, number of undesirable discharge can be decreased by including a material to the dielectric layer 22 on the address electrodes which can reduce the resistance thereof. It may be preferable that the resistance of the thickness direction of the dielectric layer is reduced from the account of the isolation between the address electrodes. However, even in the case where the resistance of the dielectric layer is reduced equally, if the functions of the dielectric layer including the isolation function between the address electrodes and the memory function for sustain discharge are maintained in reasonable level, such reduction in resistance can yield the leak function for the accumulated charges causing the random discharge.

According to the present invention, as described above, the dielectric layer which covers the address electrodes is mixed with electrically conductive particles to provide an electric conductive property in its transverse direction or an ability to reduce the electric resistance in its transverse direction. Therefore, the dielectric layer allows charges which have been stored thereon at the address electrodes by a discharge in the address period to leak to the address electrodes. Consequently, the plasma display panel has much smaller frequency of the random discharges which would otherwise be caused by an excessive storage of charges on the dielectric layer. Further, the latch-up phenomenon caused by the random discharge can be prevented.

Although a certain preferred embodiment of the present invention has been shown and described in detail, it should be understood that various changes and modifications may be made therein without departing from the scope of the appended claims.

What is claimed is:

1. A plasma display panel comprising:

a first substrate having a plurality of address electrodes disposed thereon, a first dielectric layer disposed thereon and covering said address electrodes, and partitions located between the address electrodes to create a discharge space which extends in the direction of the address electrodes; and a second substrate having a plurality of scan electrodes disposed thereon in a direction transverse to said address electrodes and a second dielectric layer disposed thereon and covering said scan electrodes;

said first substrate and said second substrate being disposed in confronting relation to each other with discharge spaces defined therebetween, wherein an address discharge occurs between the scan electrodes and the address electrodes and a sustain surface-discharge occurs at the scan electrodes, said first dielectric layer containing electrically conductive particles mixed therewith.

2. A plasma display panel according to claim 1, wherein said conductive particles comprises metal particles.

3. A plasma display panel according to claim 2, wherein said metal particles are made of either chromium Cr or nickel Ni.

4. A plasma display panel according to claim 3, wherein the average diameter of said metal particles is about 2–8 micro-meter.

5. A plasma display panel according to claim 3, wherein the inclusion ratio of said metal particles to said first dielectric layer is between 0.5–5.0 wt %.

6. A plasma display panel according to claim 3, wherein the inclusion ratio of said metal particles to said first dielectric layer is between 0.5–2.0 wt %.

7. A plasma display panel according to claim 1, wherein said conductive particles comprises conductive oxide material.

8. A plasma display panel according to claim 7, wherein said conductive oxide material comprises a semiconductor including metal oxide material doped with impurities.

9. A plasma display panel according to claim 8, wherein said metal oxide material is made of either indium oxide $In_2O_3$, tin oxide $SnO_2$, or titanium oxide $TiO_2$.

10. A plasma display panel according to claim 9, wherein the inclusion ratio of said conductive oxide material particles to said first dielectric layer is between 0.1–20 wt %.

11. A plasma display panel according to claim 9, wherein the inclusion ratio of said conductive oxide material particles to said first dielectric layer is between 2.0–10 wt %.

12. A plasma display panel according to claim 9, wherein the surface resistance of said first dielectric layer is between $1\times10^{10}$–$5\times10^{13}$ ohm/cm$^2$.

13. A plasma display panel according to claim 9, wherein the surface resistance of said first dielectric layer is between $1\times10^{11}$–$1\times10^{12}$ ohm/cm$^2$.

14. A plasma display panel according to claim 1, wherein said electrically conductive particles are mixed with said first dielectric layer to make the first dielectric layer electrically conductive anisotropically in a transverse direction thereof.

15. A plasma display panel according to claim 1, wherein said electrically conductive particles have a diameter substantially similar to a thickness of said first dielectric layer.

16. A surface-discharge plasma display panel comprising:

a pair of substrates disposed in confronting relation to each other with discharge spaces defined therebetween;

a plurality of parallel pairs of display electrodes disposed on one of said substrates and corresponding to respective display lines;

a first dielectric layer covering said parallel pairs of display electrodes;

a plurality of address electrodes disposed on the other of said substrates in a direction transverse to said parallel pairs of display electrodes;

a second dielectric layer covering said address electrodes, said second dielectric layer being electrically conductive to such an extent as to inhibit an electric short circuit between the address electrodes; and partitions located between the address electrodes to create a discharge space which extends in the direction of the address electrodes, wherein an address discharge occurs between the display electrodes and the address electrodes and a sustain discharge occurs between the pair of display electrodes.

17. A surface-discharge plasma display panel comprising:

a pair of substrates disposed in confronting relation to each other with discharge spaces defined therebetween;

a plurality of parallel pairs of display electrodes disposed on one of said substrates and corresponding to respective display lines;

a first dielectric layer covering said parallel pairs of display electrodes;

a plurality of address electrodes disposed on the other of said substrates in a direction transverse to said parallel pairs of display electrodes;

a second dielectric layer covering said address electrodes, said second dielectric layer including a material which reduces a resistance thereof; and partitions located between the address electrodes to create a discharge space which extends in the direction of the address electrodes, wherein an address discharge occurs between the display electrodes and the address electrodes and a sustain discharge occurs between the pair of display electrodes.

18. A surface-discharge plasma display panel comprising:

a pair of substrates disposed in confronting relation to each other with discharge spaces defined therebetween;

a plurality of parallel pairs of display electrodes disposed on one of said substrates and corresponding to respective display lines;

a first dielectric layer covering said parallel pairs of display electrodes;

a plurality of address electrodes disposed on the other of said substrates in a direction transverse to said parallel pairs of display electrodes;

a second dielectric layer covering said address electrodes, said second dielectric layer having a lower resistance than said first dielectric layer; and partitions located between the address electrodes to create a discharge space which extends in the direction of the address electrodes, wherein an address discharge occurs between the display electrodes and the address electrodes and a sustain discharge occurs between the pair of display electrodes.

19. A method of manufacturing a plasma display panel, wherein an address discharge occurs between an address electrode on a first substrate and a scan electrode provided on a second substrate and a sustain surface-discharge occurs at the scan electrodes, the method comprising:

mixing electrically conductive particles having a predetermined diameter with glass of low melting point;

coating and baking a layer of the glass of low melting point mixed with said electrically conductive particles on a first substrate which supports the plurality of address electrodes disposed thereon, thereby to form a first dielectric layer on the first substrate;

depositing a paste of the glass of low melting point on the first dielectric layer, selectively etching the glass pasted into a predetermined pattern, and baking the glass paste, thereby to form partitions located between the address electrodes to create a discharge space which extends in the direction of the address electrodes;

combining said first substrate in confronting relation with a second substrate which supports a plurality of scan electrodes disposed thereon in a direction transverse to said address electrodes and a second dielectric layer covering said scan electrodes;

filling a discharge gas between said first substrate and said second substrate; and sealing said first substrate and said second substrate with respect to each other.

20. A method according to claim 19, wherein said electrically conductive particles are made of either chromium or nickel.

21. A substrate assembly for AC type plasma display panel wherein an address discharge occurs between an address electrode on a first substrate and a scan electrode provided on a second substrate and a sustain surface-discharge occurs at the scan electrodes, said substrate assembly comprising:

said first substrate;

a plurality of elongated address electrodes provided on said first substrate and disposed in parallel each other;

a dielectric layer covering said address electrodes; and a plurality of stripe-shaped partitions provided on said dielectric layer and elongated in parallel to said address electrode so as to sandwich each of said address electrodes, said partitions defining elongated cavities along the address electrodes therebetween;

wherein said dielectric layer includes conductive particles therein.

22. A plasma display panel comprising:

a first substrate having a plurality of address electrodes disposed thereon, a first dielectric layer disposed thereon and covering said address electrodes, and partitions located between the address electrodes to create a discharge space which extends in the direction of the address electrodes; and a second substrate having a plurality of display electrodes disposed thereon in a direction transverse to said address electrodes and a second dielectric layer disposed thereon and covering said display electrodes;

said first substrate and said second substrate being disposed in confronting relation to each other with discharge spaces defined therebetween, wherein a sustain discharge occurs between the display electrodes, said first dielectric layer containing metal particles mixed therewith, wherein the average diameter of said metal particles is between 2–8 micro-meters.

23. A plasma display panel comprising:

a first substrate having a plurality of address electrodes disposed thereon, a first dielectric layer disposed thereon and covering said address electrodes, and partitions located between the address electrodes to create a discharge space which extends in the direction of the address electrodes; and a second substrate having a plurality of display electrodes disposed thereon in a direction transverse to said address electrodes and a second dielectric layer disposed thereon and covering said display electrodes;

said first substrate and said second substrate being disposed in confronting relation to each other with discharge spaces defined therebetween, wherein a sustain discharge occurs between the display electrodes, said first dielectric layer containing metal particles mixed therewith, wherein the inclusion ratio of said metal particles to said first dielectric layer is between 0.5–5.0 wt %.

24. A plasma display panel comprising:

a first substrate having a plurality of address electrodes disposed thereon, a first dielectric layer disposed thereon and covering said address electrodes, and partitions located between the address electrodes to create a discharge space which extends in the direction of the address electrodes; and a second substrate having a plurality of display electrodes disposed thereon in a direction transverse to said address electrodes and a second dielectric layer disposed thereon and covering said display electrodes;

said first substrate and said second substrate being disposed in confronting relation to each other with discharge spaces defined therebetween, wherein a sustain discharge occurs between the display electrodes, said first dielectric layer containing conductive oxide material particles mixed therewith, wherein the inclusion ratio of said conductive oxide material particles to said first dielectric layer is between 0.1–20 wt %.

25. A plasma display panel comprising:

a first substrate having a plurality of address electrodes disposed thereon, a first dielectric layer disposed thereon and covering said address electrodes, and partitions located between the address electrodes to create a discharge space which extends in the direction of the address electrodes; and a second substrate having a plurality of display electrodes disposed thereon in a direction transverse to said address electrodes and a second dielectric layer disposed thereon and covering said display electrodes;

said first substrate and said second substrate being disposed in confronting relation to each other with discharge spaces defined therebetween, wherein a sustain discharge occurs between the display electrodes, said first dielectric layer containing conductive oxide material particles mixed therewith, wherein the surface resistance of said first dielectric layer is between $1\times10^{10}$–$5\times10^{13}$ ohm/cm$^2$.

26. A plasma display panel comprising:

a first substrate having a plurality of address electrodes disposed thereon, a first dielectric layer disposed thereon and covering said address electrodes, and partitions located between the address electrodes to create a discharge space which extends in the direction of the address electrodes; and a second substrate having a plurality of display electrodes disposed thereon in a direction transverse to said address electrodes and a second dielectric layer disposed thereon and covering said display electrodes;

said first substrate and said second substrate being disposed in confronting relation to each other with discharge spaces defined therebetween, wherein a sustain discharge occurs between the display electrodes, said first dielectric layer containing electrically conductive particles mixed therewith, wherein said electrically conductive particles have a diameter substantially similar to a thickness of said first dielectric layer.

* * * * *